US006346913B1

(12) United States Patent
Chang et al.

(10) Patent No.: US 6,346,913 B1
(45) Date of Patent: Feb. 12, 2002

(54) PATCH ANTENNA WITH EMBEDDED IMPEDANCE TRANSFORMER AND METHODS FOR MAKING SAME

(75) Inventors: Li-Chung Chang, Whippany; James A. Housel, Stockton; Ming-Ju Tsai, Livingston, all of NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/515,229

(22) Filed: Feb. 29, 2000

(51) Int. Cl.[7] ..... H01Q 1/38; H01Q 1/24
(52) U.S. Cl. ..... 343/700 MS; 343/702
(58) Field of Search ..... 343/700 MS, 846, 343/848, 829, 830, 702, 731, 713, 859, 705, 712

(56) References Cited

U.S. PATENT DOCUMENTS

| | | | | |
|---|---|---|---|---|
| 4,835,540 A | * | 5/1989 | Haruyama et al. | 343/700 MS |
| 4,835,541 A | * | 5/1989 | Johnson et al. | 343/713 |
| 4,924,236 A | * | 5/1990 | Schuss et al. | 343/700 MS |
| 5,291,210 A | * | 3/1994 | Nakase | 343/700 MS |
| 6,072,434 A | * | 6/2000 | Papatheodorou | 343/700 MS |
| 6,184,833 B1 | * | 2/2001 | Tran | 343/700 MS |

* cited by examiner

*Primary Examiner*—Don Wong
*Assistant Examiner*—Chuc D Tran
(74) *Attorney, Agent, or Firm*—Priest & Goldstein, PLLC

(57) ABSTRACT

An antenna is described that comprises an antenna having a patch element fabricated onto a substrate, a ground plane, and an impedance transformer between the patch element and the ground plane. The patch element electrically connected to a first end of the impedance transformer, and a feed line is electrically connected to a second end of the impedance transformer through the ground plane. The use of the impedance transformer allows impedance matching to be accomplished without being limited by the physical limitations of the patch element. According to a further aspect of the invention, a patch element is fabricated onto a first substrate surface and a ground plane is fabricated onto a second substrate surface, the ground plane separated from the patch element by a plurality of substrate layers. An impedance transformer is embedded between abutting substrate layers between the patch element and the ground plane, and an electrically conductive via connects a first end of the impedance transformer to a feed point on the patch element. The antenna further includes a coaxial feed having an outer conductor electrically connected to the ground plane and an inner conductor electrically connected to a second end of the impedance transformer, such that a signal is carried between the coaxial feed and the patch element through the impedance transformer.

8 Claims, 6 Drawing Sheets

PATCH ANTENNA WITH EMBEDDED IMPEDANCE TRANSFORMER AND METHODS FOR MAKING SAME

BACKGROUND OF THE INVENTION

1. Field of the Invention

The present invention relates generally to improvements to antennas, and more particularly to advantageous aspects of a microstrip patch antenna with an embedded impedance transformer.

2. Description of the Prior Art

In a typical microstrip patch antenna, the radiator element is provided by a metallic patch that is fabricated onto a dielectric substrate over a ground plane. Microstrip patch antennas play an important role in the antenna field because of their many desirable features. These include their low profile, reduced weight, relatively low manufacturing cost, polarization diversity and a relatively easy integration process that allows many identical patches to be grouped into arrays and to be integrated with circuit elements.

In order to function efficiently, an antenna's input impedance should match that of its transmission feed line. Various techniques are used to accomplish impedance matching in a microstrip patch antenna. In a patch antenna employing a coaxial feed, illustrated in FIG. 3 and described below, impedance matching is typically accomplished by adjusting the position of the patch element feed point. However, as discussed below, the range of impedance matching available using this approach is limited by the physical dimensions of the patch element.

Although it would be theoretically possible to obtain the desired impedance matching by varying the design parameters of the patch antenna other than the size of the patch element, this variation is often not practical. The input impedance of a microstrip patch antenna is determined by a number of factors, including the dimensions of the patch, the height of the substrate, and by dielectric parameters. However, there can be relatively limited flexibility in the adjustment of these factors. For example, the dielectric loading of the antenna as well as the patch dimensions may be dictated by the required beamwidth and resonance characters for the antenna.

The prior art can be better understood with reference to FIGS. 1 through 3, which illustrate three basic techniques that are currently used to feed a microstrip antenna. These include, respectively, transmission line feed, aperture feed, and coaxial feed.

FIG. 1 shows a perspective view of a patch antenna 10 employing a transmission line feed technique. As shown in FIG. 1, antenna 10 includes a substantially square patch element 12 that has been fabricated onto a dielectric substrate 14 lying on top of a ground plane 16. The feed line 18 to the patch element 12 has been fabricated onto the same substrate 14 as the patch element 12 and directly connects to an edge of the patch element 12, with an inset 20 cut into the patch 12. The transmission line feed is a very simple way to feed a microstrip patch. Impedance matching is accomplished by adjusting the dimensions of the inset 20.

The transmission line feed approach suffers from several problems. First, since the feed line and the patch element are on the same level, they cannot be optimized simultaneously. Second, the feed line in this structure functions as another radiator, which generates spurious radiation and results in degradation of cross-polarization discrimination and pattern performance. In addition, in order to control the radiation from the feed line, the line width cannot be too wide, which results in a relatively thin substrate. It is known that, in general, the bandwidth of a microstrip antenna is proportional to the thickness of the substrate. Therefore, this type of feed leads to a narrow bandwidth structure.

FIG. 2 shows a partial cutaway perspective view of a patch antenna 30 utilizing the aperture feed approach. The antenna 30 includes a patch element 32 that has been fabricated onto a first dielectric substrate 34 lying on top of a ground plane 36. A microstrip feed line 38 is fabricated onto the bottom surface of a second dielectric substrate 40 lying underneath the ground plane 36. Coupling between the microstrip feed line 38 and the patch element 32 is accomplished by a slot 42 in the ground plane 40 that lies across the microstrip feed line 38. Finally, a metal plate reflector 44 is typically provided underneath the other antenna elements to reduce spurious radiation from the slot opening 42 in the ground plane 36.

The aperture feed approach rectifies several drawbacks associated with the transmission line feed approach, including the spurious radiation from the microstrip feed line and fundamental bandwidth limitations because the microstrip feed line 38 is underneath the ground plane 36 and can be designed independently. However, because of the existence of the reflector 44, it is possible for parallel modes to be easily excited and travel between the ground plane and the reflector. These parallel modes degrade the antenna radiation efficiency. Therefore, one major challenge in the aperture feed structure is how to suppress parallel modes.

FIG. 3 shows a perspective view of a patch antenna 50 employing the coaxial feed approach. The antenna 50 includes a patch element 52 fabricated on top of a dielectric substrate 54. A ground plane 56 abuts the lower surface of the dielectric substrate 52. Finally, a coaxial feed line 58 is mounted perpendicular to the lower surface of the ground plane 56. The outer conductor 60 of the coaxial feed line 58 is electrically connected to the ground plane 56, and the inner conductor 62 of the coaxial feed line 58 is electrically connected to the underside of the patch element 52. The input impedance is a function of the position of the feed 62 into the patch element 52. Thus, the impedance of the patch antenna 50 can be matched to the line by properly positioning the feed line 58. Because the coaxial feed line 58 directly carries current to the radiation element, patch 52, it provides a more stable signal coupling than the aperture feed structure. In addition, with a coaxial feed approach there is less concern regarding parallel mode excitation in those situations where a higher dielectric loading is required to achieve certain electrical performance characteristics such as a wider beamwidth.

In the coaxial feed approach illustrated in FIG. 3, the position of the feed can be critical in matching the input impedance of the patch element, particularly since other factors determining the input impedance, such as the patch dimensions, the height of the substrate, and the dielectric parameters, may be dictated by required antenna specifications, such as the antenna beamwidth and resonant frequency. However, in certain situations, it may be difficult or impossible to find a desired matched feed position within the available patch dimensions. Thus, the range of impedance matching available for a given microstrip patch antenna is limited.

SUMMARY OF THE INVENTION

The above-described issues and others are addressed by the present invention, one aspect of which provides an antenna having a patch element fabricated onto a substrate, a ground plane, and an impedance transformer between the patch element and the ground plane. The patch element electrically connected to a first end of the impedance transformer, and a feed line is electrically connected to a second end of the impedance transformer through the ground plane. The use of the impedance transformer allows impedance matching to be accomplished without being limited by the physical limitations of the patch element. According to a further aspect of the invention, a patch element is fabricated onto a first substrate surface and a ground plane is fabricated onto a second substrate surface, the ground plane separated from the patch element by a plurality of substrate layers. An impedance transformer is embedded between abutting substrate layers between the patch element and the ground plane, and an electrically conductive via connects a first end of the impedance transformer to a feed point on the patch element. The antenna further includes a coaxial feed having an outer conductor electrically connected to the ground plane and an inner conductor electrically connected to a second end of the impedance transformer, such that a signal is carried between the coaxial feed and the patch element through the impedance transformer.

Additional features and advantages of the present invention will become apparent by reference to the following detailed description and accompanying drawings.

DETAILED DESCRIPTION

One aspect of the present invention provides a microstrip patch antenna that includes a patch element fabricated onto a substrate, a ground plane, and an impedance transformer between the patch element and the ground plane. The patch element is electrically connected to a first end of the impedance transformer, and a feed line is electrically connected to a second end of the impedance transformer through the ground plane. It has been found that this technique can significantly improve the range of impedance matching available for a given microstrip patch antenna. A typical coaxial feed may have an impedance of approximately 50Ω. A typical patch element, with a central feed point, may have an impedance in the range of 150–200Ω. As described above, in the prior art, impedance matching is accomplished by moving the feed point of the patch element away from its center. However, this means that the range of impedance matching available is limited by the physical dimensions of the patch. Providing a separate impedance transformer removes this physical limit, allowing impedance matching in those situations in which the dimensions of the patch element are dictated by other design considerations.

Further the present invention can be used to address a known fundamental drawback of the microstrip patch antenna, which is its limited bandwidth. By integrating the broadband matching technique described below with existing broadband approaches, such as stack patch design, the technique can be used to enhance bandwidth performance.

Figure 1:
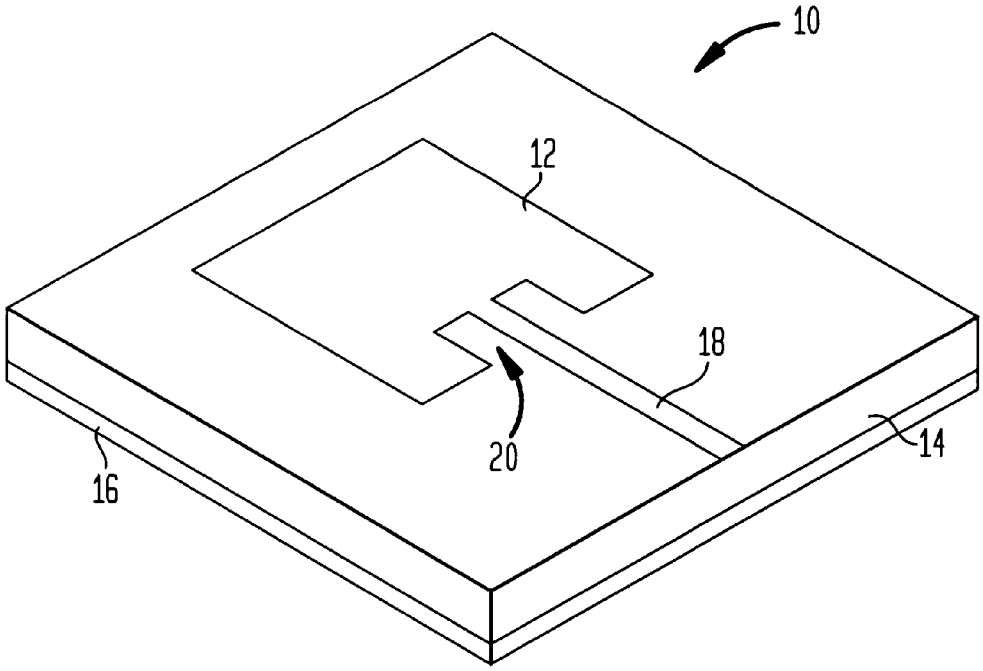
FIG. 1 (PRIOR ART)
FIG. 1 shows a perspective view of a patch antenna according to the prior art utilizing a transmission line feed.
Figure 2:
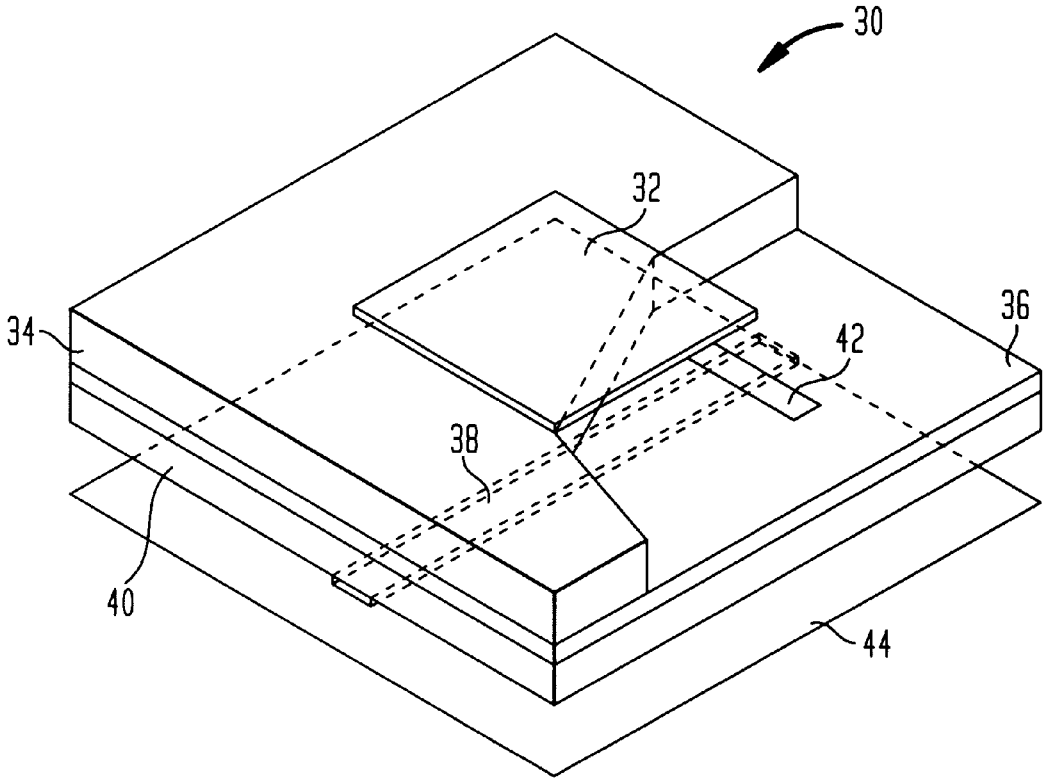
FIG. 2 (PRIOR ART)
FIG. 2 shows a partial cutaway perspective view of a patch antenna according to the prior art utilizing an aperture feed.
Figure 3:
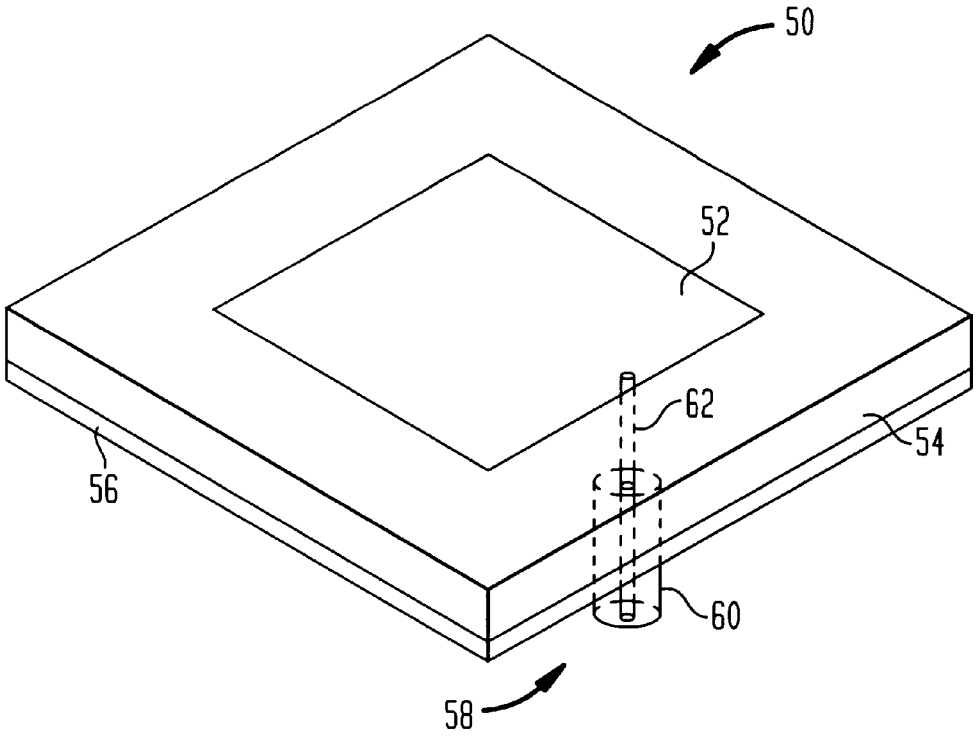
FIG. 3 (PRIOR ART)
FIG. 3 shows a perspective view of a patch antenna according to the prior art utilizing a coaxial feed.
Figure 4A:
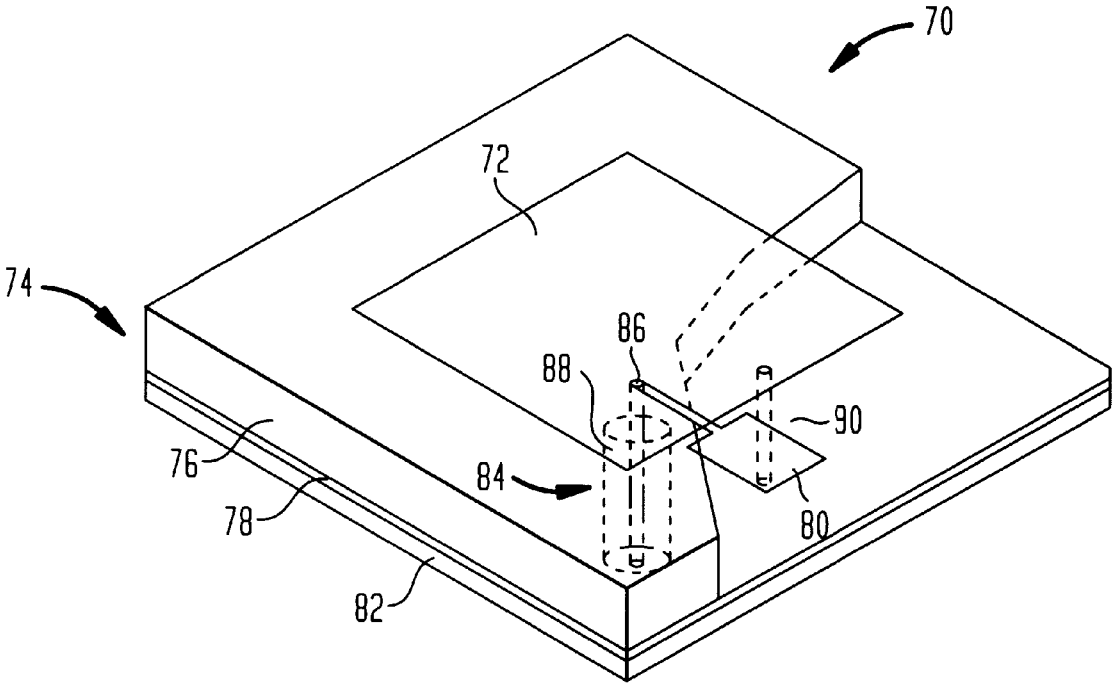
FIG. 4A shows a partial cutaway perspective view of a first embodiment of a patch antenna with an embedded impedance transformer according to the present invention.
Figure 4B:
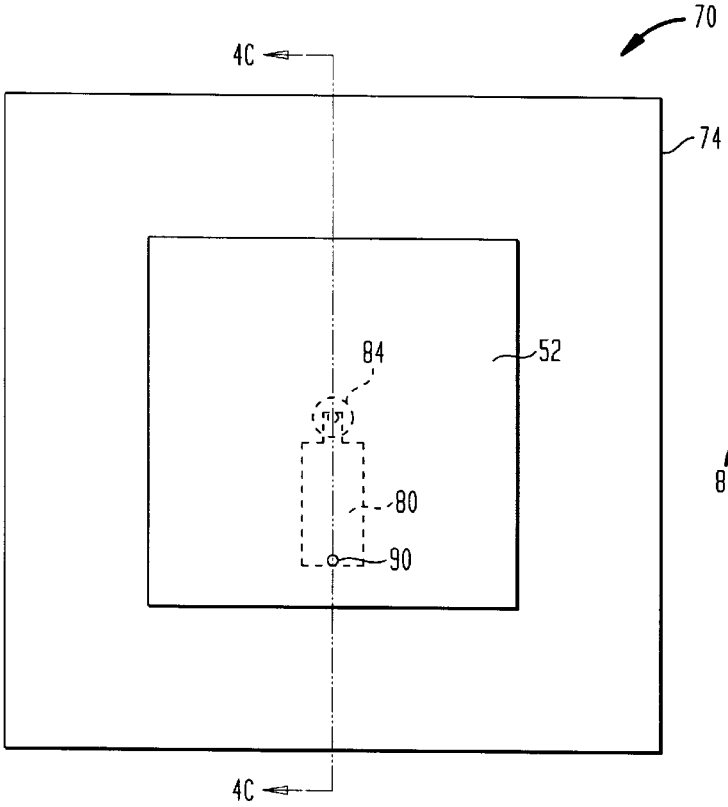
FIG. 4B shows a top view of the patch antenna shown in FIG. 4A.
Figure 4C:
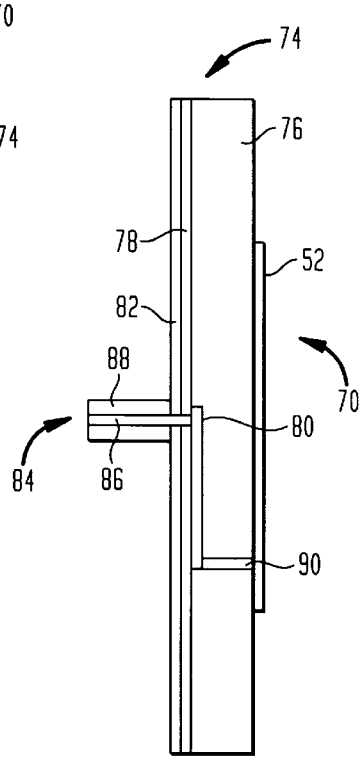
FIG. 4C shows a cross section of the antenna shown in FIGS. 4A and 4B through the plane C—C.

FIG. 4A shows a partial cutaway perspective view of a patch antenna 70 according to a first embodiment of the present invention. FIG. 4B shows a top view of the antenna 70, and FIG. 4C shows a cross section of the antenna 70 through the plane C—C. For the purposes of illustration, FIG. 4A has been drawn with a transparent patch element 32 and first substrate 34. The antenna 70 includes a patch element 72 fabricated onto the upper surface of a dielectric substrate 74 having upper and lower layers 76 and 78. Sandwiched between the upper layer 76 and the lower layer 78 is an impedance transformer 80. In a presently preferred embodiment of the invention, the impedance transformer 80 is implemented as a metallic strip that effectively increases the line width, thereby lowering the antenna load impedance such that it matches the signal input impedance. The dimensions of the impedance transformer 80 are calculated by running simulations to obtain the desired impedance characteristics. The bottom surface of the lower substrate layer 78 includes a ground plane 82. Mounted perpendicular to the bottom surface of the ground plane 82 is a coaxial feed 84 having an inner conductor 86 and an outer conductor 88. One end of the impedance transformer 82 is connected to a feed point on the patch element by a via 90. The other end of the impedance transformer 80 is connected to the inner conductor 86 of the coaxial feed 84. Thus, the signal is carried from the coaxial feed 84, passing through the transformer 80, through the via 90 to the patch 72.

As shown in FIGS. 4A through 4C, the coaxial feed 84 is positioned such that it lies beneath the center of the patch element 72, where the input impedance is equal to zero. Because of the existence of the transformer 80, the location of the via 90 for impedance matching is not as critical as the traditional coaxial feed structure. It is possible to design the impedance transformer 80 to match the impedance between the via 90 and the coaxial feed 84.

Figure 5A:
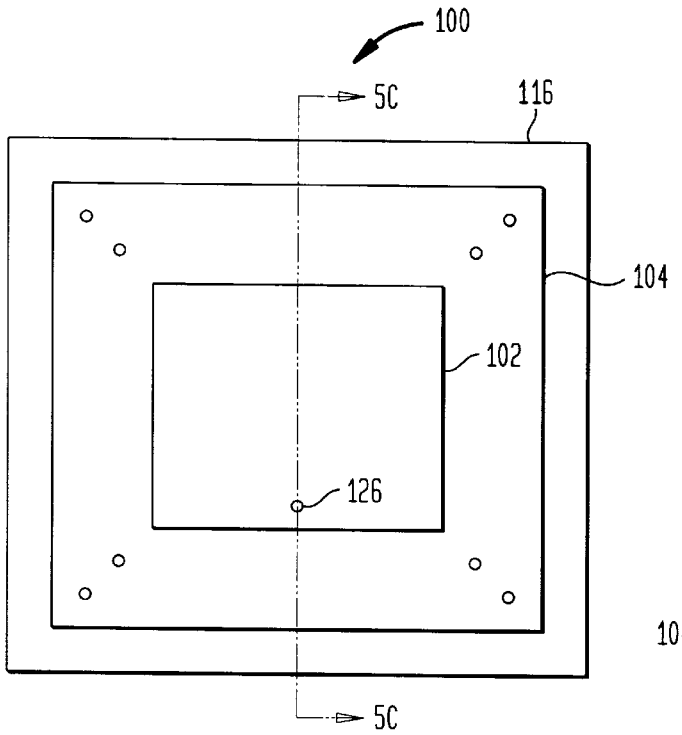
FIG. 5A shows a top view of a further embodiment of a patch antenna with an embedded impedance transformer according to the present invention.
Figure 5C:
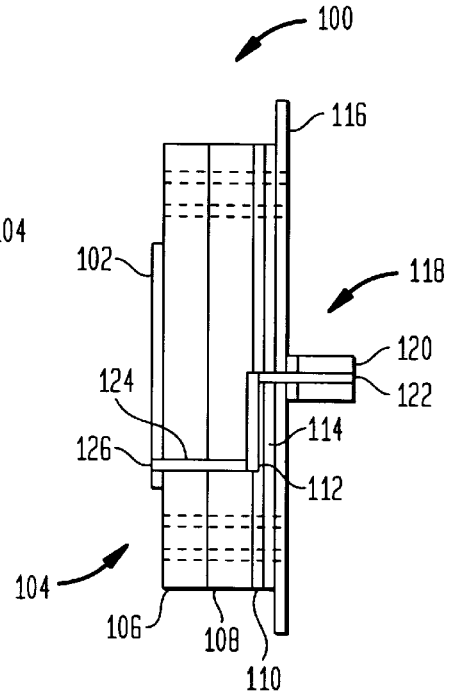
FIG. 5C shows a cross section of the antenna shown in FIGS. 5A and 5B through the plane C—C.
Figure 5B:
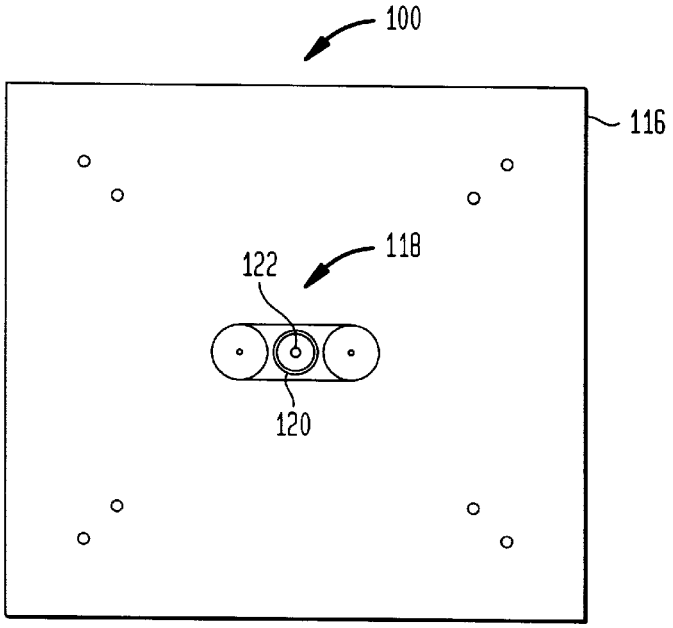
FIG. 5B shows a bottom view of the antenna shown in FIG. 5A.

FIGS. 5A and 5B show, respectively, top and bottom views of a further embodiment of a microstrip patch antenna 100 according to the present invention. FIG. 5C shows a cross section of the antenna 100 shown in FIGS. 5A and 5B through the plane C—C. As shown in FIGS. 5A through 5C, the antenna 100 includes a patch element 102 fabricated onto the top surface of a dielectric substrate 104 having three layers, a top layer 106, a middle layer 108, and a bottom layer 110. As discussed further below, the use of a three-layer substrate facilitates the manufacturing process. An impedance transformer 112 is sandwiched between the middle substrate layer 108 and the bottom substrate layer 110. The lower surface of the bottom substrate layer 110 is clad with copper or other conductor to form a ground plane 114. An outer metal base plate 116 is mounted to the outer side of the ground plane 114. A coaxial feed 118 is mounted to the center of base plate 116, perpendicular thereto. The outer conductor 120 of the coaxial feed 118 is connected to the ground plane 114, and the inner conductor 122 of the coaxial feed 118 is connected to a first end of the impedance transformer 112. A second end of the impedance transformer 112 is electrically connected to a feed point 126 on the patch element 102 by a via 124. In the present embodiment of the invention, the via 124 is a electrically conductive metal pipe extending through the top and middle substrate layers 106 and 108.

Figure 6:
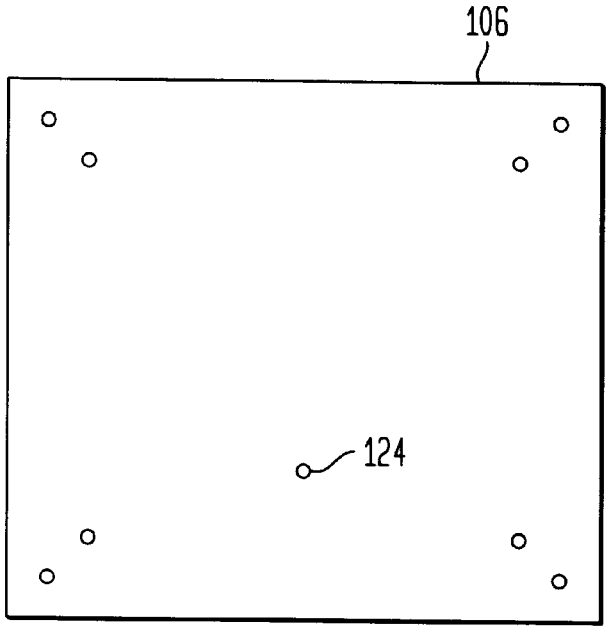
FIG. 6 shows a bottom view of the top substrate layer of the antenna shown in FIGS. 5A through 5C.
Figure 7:
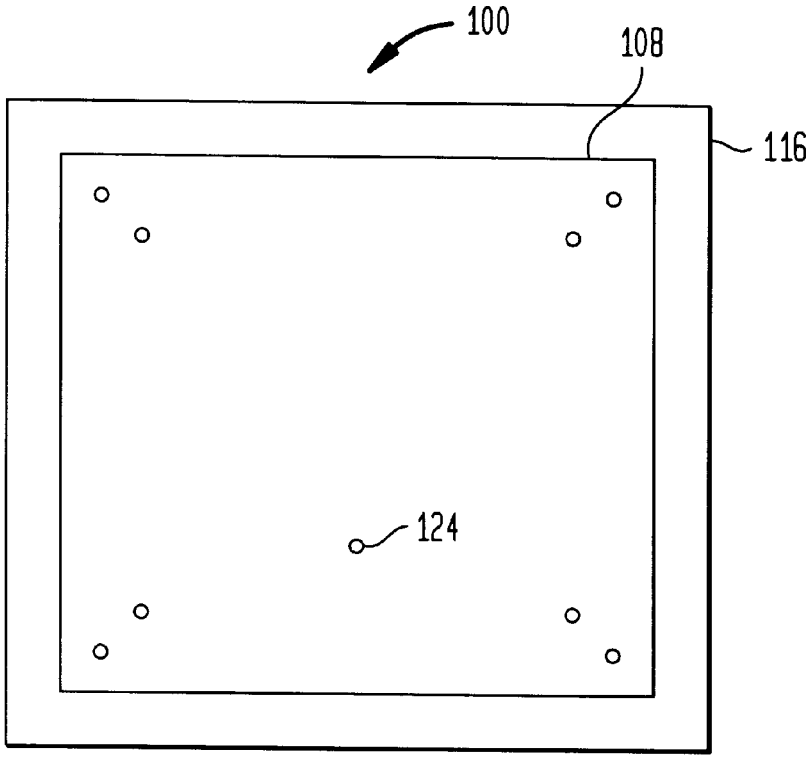
FIG. 7 shows a top view of the antenna shown in FIGS. 5A through 5C with the top substrate layer removed.
Figure 8:
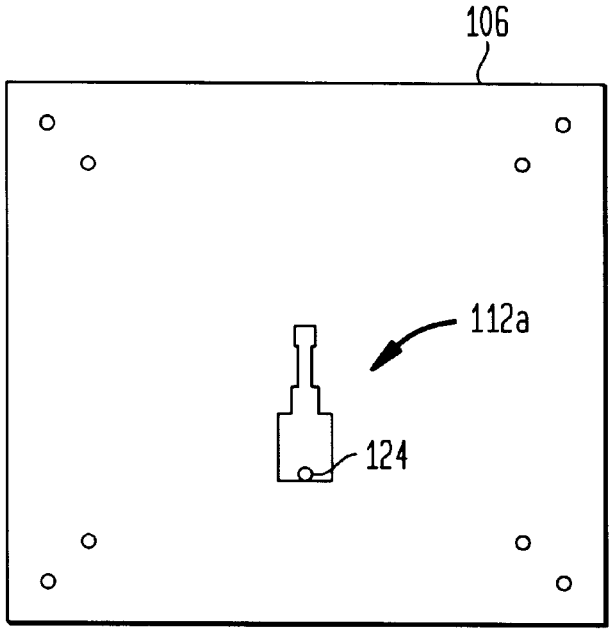
FIG. 8 shows a bottom view of the middle substrate layer of the antenna shown in FIGS. 5A through 5C.
Figure 9:
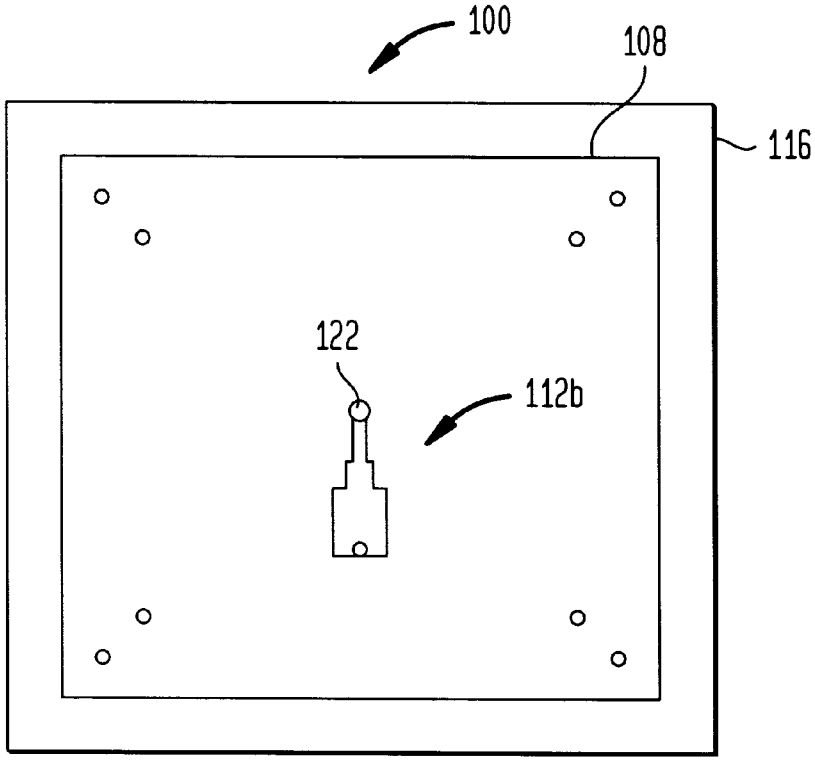
FIG. 9 shows a top view of the antenna shown in FIGS. 5A through 5C with the top and middle substrate layers removed.

FIG. 6 shows a bottom view of the top substrate layer 106, and FIG. 7 shows a top view of the components of the antenna 100 with the top substrate layer 106 removed. FIG. 8 shows a bottom view of the middle substrate layer 108 and, and FIG. 9 shows a top view of the components of the antenna 100 with both the top substrate layer 106 and the middle substrate layer 108 removed. As shown in FIGS. 6 and 7, the lower surface of the top substrate layer 106 and the upper surface of the middle substrate layer 108 are blank, having no metallic elements fabricated thereon. As shown in FIGS. 8 and 9, the impedance transformer includes an upper portion 112*a* fabricated onto the lower surface of the middle substrate layer 108 and a lower portion 112*b* fabricated onto the upper surface of the bottom substrate layer 110. In the finished antenna, the upper and lower portions 112*a–b* of the impedance antenna are in electrical contact with each other and function as a single, integral structure.

It will be seen that the top substrate layer 106 and the middle substrate layer 108 each have one blank surface and one surface with a metallic antenna component fabricated thereon. This approach simplifies the manufacturing of the antenna, as the process used to fabricate these metallic components only has to be performed on one side of each substrate. Of course, if desired, the top substrate layer 106 and the middle substrate layer 108 can be combined into a single substrate layer. Further, other construction techniques may be used to embed the impedance transformer into the substrate other than sandwiching the transformer between substrate layers. In such an embodiment of the invention, it would be possible to use a substrate having only a single layer.

The present invention provides a powerful impedance matching technique for the coaxial feed microstrip patch antenna design, thereby opening the door to realizing a broadband design using a coaxial feed structure. Antenna designers can thus focus on obtaining a small voltage standing wave ratio (VSWR) locus without worrying about its location in the Smith chart. Instead, they can rely on the embedded transformer to bring the locus to the Smith chart center for a broadband matching. This approach combines the merits of matching techniques associated with the aperture feed structure and the stability as well as the efficiency of the coaxial feed structure.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

We claim:

1. A method for constructing an antenna, comprising the following steps:

(a) fabricating a patch element onto a first substrate surface;

(b) fabricating a ground plane onto a second substrate surface;

(c) embedding an impedance transformer between abutting substrate layers between the patch element and the ground plane;

(d) connecting a first end of the impedance transformer to a feed point on the patch element; and (e) connecting the outer conductor of a coaxial feed to the ground plane and the inner conductor of the coaxial feed to a second end of the impedance transformer.

2. The method of claim 1, further including:

(f) using the impedance transformer to match the impedance between the via and the coaxial feed.

3. The method of claim 1, wherein step (d) includes:

using a via to connect a first end of the impedance transformer to a feed point on the patch element, the via extending through the substrate.

4. The method of claim 1, wherein step (e) includes mounting the coaxial feed perpendicular to the ground plane.

5. The method of claim 4, wherein step (e) includes centering the coaxial feel underneath the patch element.

6. The method of claim 1 wherein:

step (a) includes fabricating the patch element onto an upper surface of the first substrate;

step (b) includes fabricating the ground plane onto the lower surface of a second substrate;

step (c) includes embedding the impedance transformer between a lower surface of the first substrate and an upper surface of a second substrate; and step (d) includes using a via to electrically connect one end of the impedance transformer with a feed point on the patch element, the via extending through the first substrate.

7. The method of claim 1, wherein step (a) includes:

fabricating a patch element onto a first substrate surface, the substrate including first and second layers.

8. The method of claim 7, wherein step (c) includes:

fabricating an upper portion of the impedance transformer onto a lower surface of the second layer of the first substrate; and fabricating a lower portion of the impedance transformer onto the upper surface of the second substrate.

* * * * *